US005767650A

United States Patent [19]

Dehli et al.

[11] Patent Number: 5,767,650

[45] Date of Patent: Jun. 16, 1998

[54] DISPLAY APPARATUS WITH DC GEAR MOTOR DRIVE CONTROL

[75] Inventors: Hans J. Dehli, Dana Point, Calif.; Jaspal Sethi Attrey, Charlotte, N.C.; Francis Frederick Dyer, Lake Jackson, Tex.

[73] Assignee: Admotion Corporation, Irvine, Calif.

[21] Appl. No.: 602,984

[22] Filed: Feb. 16, 1996

[51] Int. Cl.[6] ..... H02P 8/00

[52] U.S. Cl. ..... 318/640; 318/446; 318/466; 318/484; 40/466

[58] Field of Search ..... 40/463–467, 423; 318/640, 445, 446, 466, 470, 484

[56] References Cited

U.S. PATENT DOCUMENTS

| | | | |
|---|---|---|---|
| 3,277,597 | 10/1966 | Trame . | |
| 3,742,631 | 7/1973 | Hasala . | |
| 3,747,243 | 7/1973 | Schneider . | |
| 3,827,797 | 8/1974 | Eaves . | |
| 3,862,504 | 1/1975 | Ringelheim et al. . | |
| 3,883,966 | 5/1975 | Ludwig . | |
| 3,918,185 | 11/1975 | Hasala . | |
| 3,928,846 | 12/1975 | Arai et al. . | |
| 4,067,006 | 1/1978 | Saylor et al. | 340/325 |
| 4,092,791 | 6/1978 | Apissomian . | |
| 4,142,794 | 3/1979 | Trump . | |
| 4,159,176 | 6/1979 | De Masi . | |
| 4,246,713 | 1/1981 | Eckert . | |
| 4,860,471 | 8/1989 | Bonanomi . | |
| 4,864,361 | 9/1989 | Amao et al. . | |
| 4,878,086 | 10/1989 | Isohata et al. . | |
| 4,897,802 | 1/1990 | Atkinson et al. . | |
| 4,910,789 | 3/1990 | Akiyama et al. | 318/640 |
| 5,440,214 | 8/1995 | Peeters . | |
| 5,488,791 | 2/1996 | Boni | 40/467 |
| 5,513,458 | 5/1996 | Dehli | 40/470 |

*Primary Examiner*—Brian Sircus

*Attorney, Agent, or Firm*—Fulwider Patton Lee & Utecht, LLP

[57] ABSTRACT

A display device for sequentially displaying multiple sets of image pixels formed on a transparent mosaic through an aperture pattern formed in a substantially opaque mask. An DC gear motor and drive assembly is employed to move the mosaic through a predetermined travel path relative to the mask to sequentially register the image sets with the aperture pattern. A control system is employed to temporarily deactivate the gear motor at predetermined precise positions to display the various images through the aperture pattern.

26 Claims, 4 Drawing Sheets

DISPLAY APPARATUS WITH DC GEAR MOTOR DRIVE CONTROL

BACKGROUND OF THE INVENTION

1. Field of the Invention

The present invention relates to advertising displays for sequentially displaying multiple high resolution images in a single display and, more particularly, to a gear motor drive and control assembly for such a display apparatus.

2. Description of the Prior Art

With the advent of modern display advertising, limitations on advertising budgets and limited locations for display to high densities of potential customers, a great demand has arisen for display advertising which allows for the display of multiple advertisements at one desirable display location to thereby enable a number of advertisers to benefit from the single location. In addition, it is desirable to provide such a device which may be utilized in relatively confined spaces, such as immediately adjacent to the product or products themselves. Thus, devices of this type typically are used in public retail outlets or other public locations frequented by a large number of potential purchasers.

Numerous different methods and devices have been proposed for preparing and displaying such advertisements. Many such devices involve relatively unwieldy mechanical elements driven by complex drive mechanisms which tend to be relatively bulky. Thus such devices will typically be relatively large and expensive to manufacture and therefore not suitable for display in relatively confined areas and in many cases not economically feasible in lieu of conventional advertising displays.

Display devices have been proposed which include generally opaque screens formed with aperture patterns defining numbers, letters or figures to be illuminated by a light source placed behind such screen. Examples of such devices are disclosed in U.S. Pat. No. 1,172,455 to Hildburgh and in U.S. Pat. No. 4,246,713 to Eckert. However, such devices include no means for sequentially displaying distinct advertisements or images which cover substantially the entire display screen.

There are also prior art devices which include transparent sheets formed with images thereon and which are illuminated by back lighting and cooperate with movable opaque masks including aperture patterns for selectively registering the aperture pattern with one of the images formed on the transparent sheet. Examples of such devices are disclosed in U.S. Pat. No. 4,092,791 to Apissomian and in U.S. Pat. No. 3,918,185 to Hasala. These devices are not free from shortcomings, however. In the first place, the devices incorporate relatively complex drive assemblies in order to sequentially align the various images on the sheets with the aperture pattern on the masks. In addition, the drive assemblies incorporated in those devices are somewhat imprecise, thus requiring the apertures in the masks to be formed with somewhat smaller dimensions than those of the image cells to allow for a certain degree of misalignment which results in some of the image being blocked and thus a reduction in resolution of the images displayed.

Yet another device which includes a translucent image screen comprising a mosaic of discrete images formed by relatively small translucent pixels interlaced and arranged in uniform groups for sequential alignment with an aperture pattern formed on a stationary mask is disclosed in U.S. Pat. No. 4,897,802 to Atkinson et al., assigned to the assignee of the present application. The device exhibits excellent operational characteristics. However, the device incorporates a somewhat complex and expensive drive assembly including drive motors mounted at each of the respective corners of the apparatus for displacing the mosaic relative to the grid mask to sequentially display the discrete images formed on the mosaic.

Still another prior art device designed for sequentially displaying a plurality of images formed on one sheet is disclosed in U.S. Pat. No. 5,440,214 to Peeters, likewise assigned to the assignee of the present invention. The device disclosed in the patent is an efficient, reliable apparatus that provides for the sequential display of multiple high resolution images in a fast and accurate manner. This device, while having been well received commercially, is relatively expensive to manufacture due to the fact that it employs a microprocessor-controlled stepper motor in order to drive the mosaic to sequentially register the image pixel sets with the apertures in the mask.

As such, it will be appreciated that there continues to be a need for a display apparatus which incorporates a relatively simple, precise drive assembly to sequentially register the image pixel sets with the aperture pattern in the mask and which further includes an economical control assembly for interrupting the operation of the drive assembly at various swell points to display the images for predetermined amounts of time. The instant invention addresses such needs.

SUMMARY OF THE INTENTION

Briefly, and in general terms, the present invention is directed to a display apparatus which sequentially displays sets of image pixels corresponding with discrete images interlaced on a transparent mosaic through an aperture pattern formed in a substantially opaque mask, and to a control system incorporated in the apparatus which alternately actuates and deactivates the apparatus in order to display the respective images for predetermined amounts of time. The apparatus includes a housing comprising a mounting assembly to mount the mask and mosaic thereon and a drive assembly engageable with at least one of the mask and mosaic and operative to move the engaged sheet or sheets through a predetermined travel path to sequentially register the pixel sets with the apertures in the mask. A DC motor is mounted in the housing and is coupled with the drive assembly and is operative to actuate the drive assembly.

The control system in one embodiment includes a position indicator in the form of a slotted wheel mounted on the drive shaft of the motor. An optical interrupter module mounts over the periphery of the slotted wheel for generation of a deactivate control signal when one of the slots on the wheel aligns with the optical interrupter module. The control system further comprises a timing circuit responsive to the deactivate control signal to temporarily deactivate the DC gear motor. The timing circuit also includes reactuating circuitry which is responsive to the deactivation of the gear motor to reactuate same after a predetermined amount of time has elapsed to repeat the process.

DETAILED DESCRIPTION OF THE PREFERRED EMBODIMENT

Figure 1:
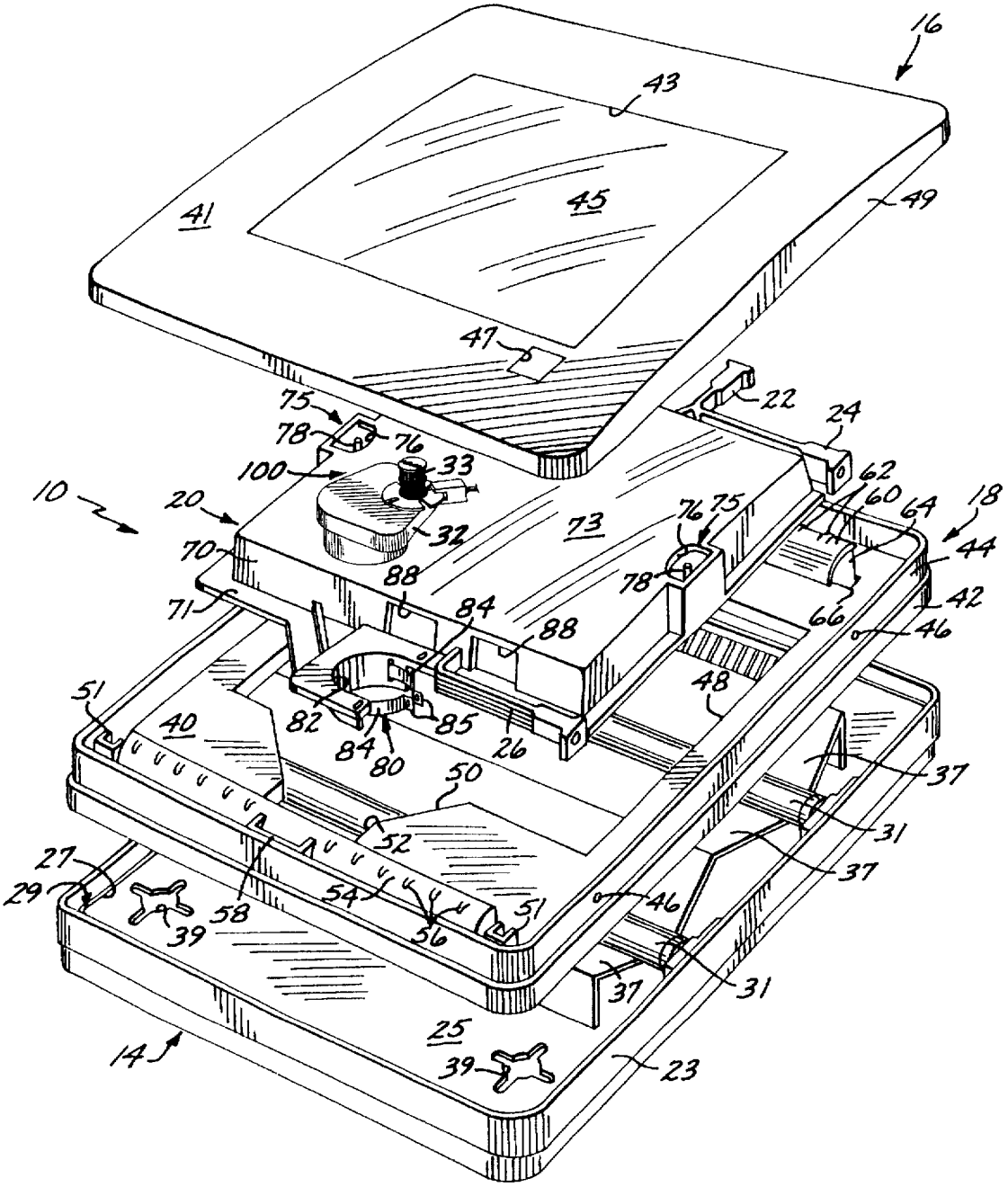
FIG. 1 is an exploded perspective view of a display apparatus embodying certain aspects of the present invention.
Figure 2:
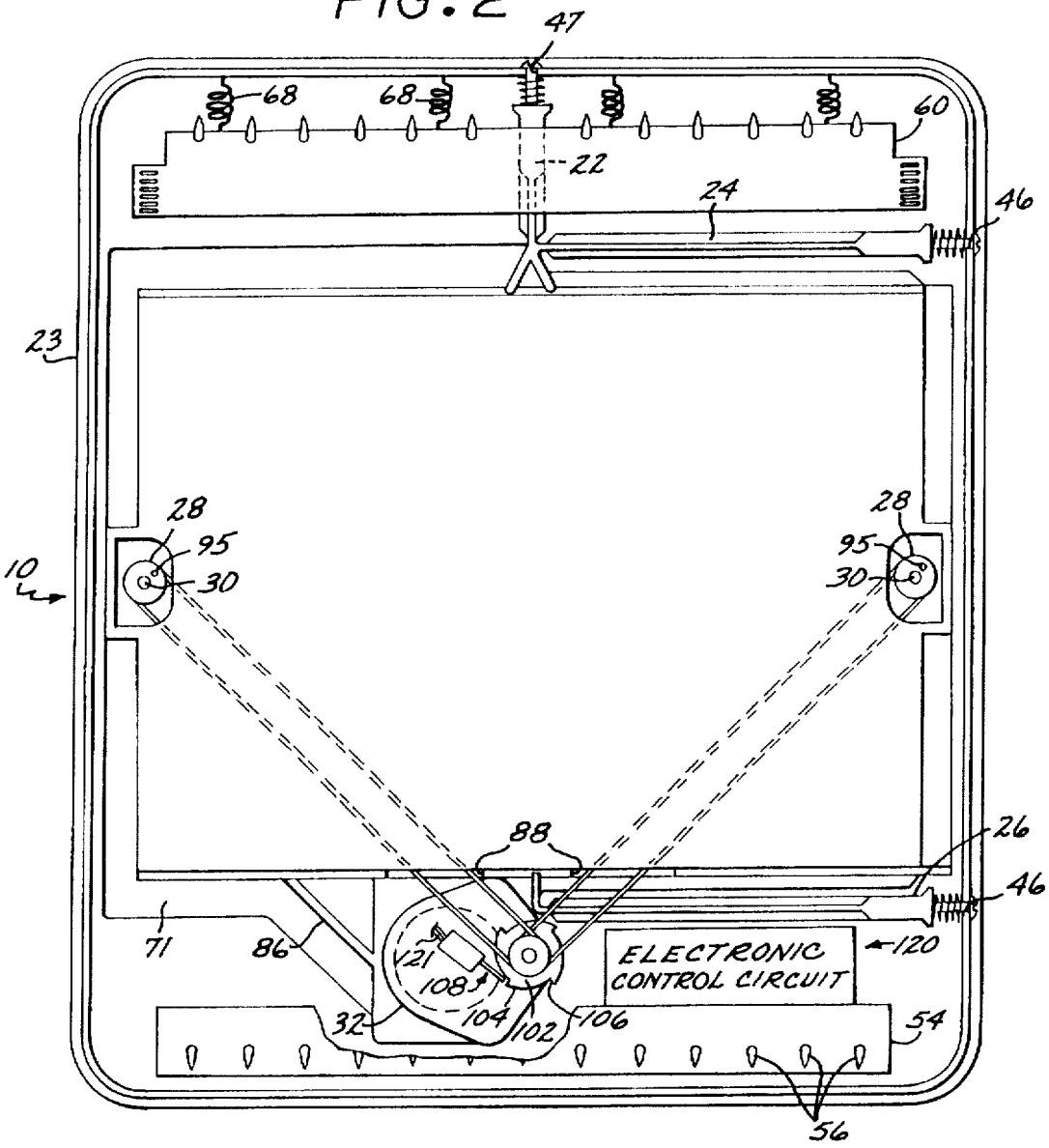
FIG. 2 is a horizontal cross-sectional view, in enlarged scale, of the apparatus shown in FIG. 1.

In the following detailed description, like reference numerals will be used to refer to like or corresponding elements in the different figures of the drawings. Referring now to the drawings, and particularly to FIGS. 1 and 2, there is shown, generally, a display apparatus 10 of the type disclosed in patent application, Ser. No. 08/575,410, filed Dec. 20, 1995, and now U.S. Pat. No. 5,657,565, which is incorporated herein by reference and will be described herein because it embodies certain aspects of the present invention and is provided for exemplary purposes to illustrate one type of display apparatus which may be used with the present invention. Referring to FIGS. 1 and 2, the display apparatus 10 comprises, generally, a housing 12 including a rectangular base pan 14 and cover 16. The housing houses therein a frame assembly comprising, generally, a rectangular main frame 18 and a platen frame 20 carried within the main frame for adjustable movement relative thereto.

Figure 3:
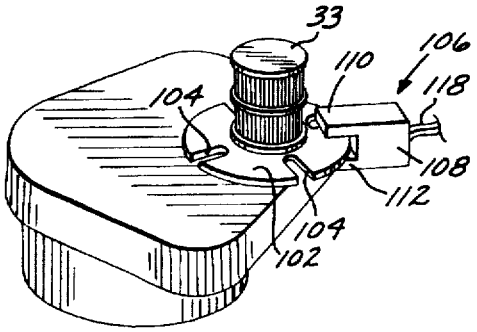
FIG. 3 is a perspective view, in enlarged scale, of a gear motor and timing control system included in the apparatus shown in FIG. 1.
Figure 5:
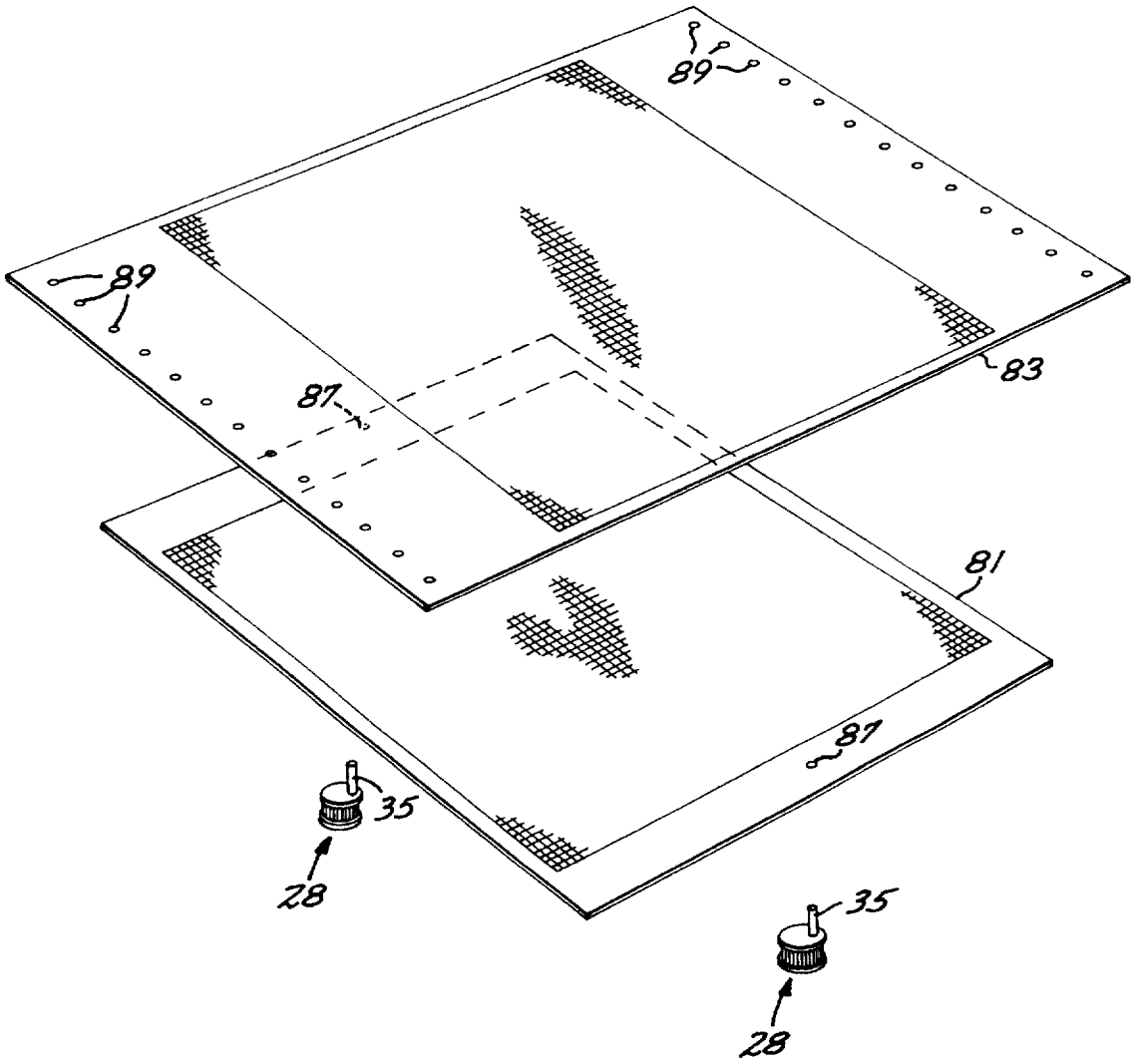
FIG. 5 is an exploded perspective view of a mosaic and mask for mounting on the apparatus shown in FIG. 1.

The platen frame 20 includes a plurality of flexible, resilient, spaced apart biasing arms 22, 24 and 26 projecting cantileverly from the opposite ends thereof for adjustable connection at their respective distal ends with the main frame to allow the platen frame to be displaced relative to the main frame. The platen frame rotatably mounts on the opposite sides thereof a pair of eccentric drives, generally designated 28 (FIG. 2). The eccentric drives are rotated by means of a gear motor 32 mounted to the bottom end of such platen frame 20 to drive a pair of endless timing drive belts 34 threaded over a double grooved drive pinion 33 carried on the motor drive shaft 35 (FIG. 3). While such drive motor may take many different forms, one which has proven to perform well is a synchronous motor and gear box, Model No. 800i, available from Cramer Co., Old Saybrook, Conn. U.S.A. A mosaic 81 comprising a plurality of interlaced pixels corresponding with a plurality of discrete images may be releasably mounted on the platen frame 20 to be drivingly engaged with the respective eccentric drives by means of respective mounting bores 87 to be driven thereby through a predetermined closed loop path (FIG. 5). A generally opaque mask 83 having a uniform aperture pattern formed thereon and a plurality of bores 89 may be mounted on the main frame 18 between the mosaic on such platen frame and the cover 16 to provide for sequential registration of the image pixels, corresponding to the respective discrete images formed on the mosaic, with the aperture pattern on the mask as the mosaic is displaced relative to the mask during operation of the eccentric drives.

The base pan 14 is generally rectangular in cross-section and includes a back plate 25 and an upstanding peripheral wall 23 and a coextensive upstanding interior wall 27 (FIG. 1). The respective walls cooperate to define therebetween a peripheral, upwardly opening groove 29 for receipt therein of the bottom marginal edge of the main frame 18 as described in greater detail below. Referring to FIG. 1, the pan mounts therein a pair of spaced apart light tubes 31 interposed between a plurality of laterally projecting, triangularly shaped reflectors 37 which extend, at their respective apexes, outwardly above the plane of the outermost peripheries of the respective tubes to thus protect the tubes from being struck when the main frame is manipulated about during assembly. The back plate 25 is formed at its four corners with spaced apart cruciform mounting holes 39 for conveniently mounting of the display apparatus 10 in an out of the way location such as on a hanger projecting from a wall.

The cover 16 is generally rectangular in cross-section and includes a domed upper face 41 formed with a square central opening defining a window 43 having a lens 45 therein through which the mosaic may be viewed when mounted on the platen frame 20 (FIG. 1). The cover further includes a small offset square opening 47 spaced from one corner of the window 43. The cover includes a downwardly projecting peripheral skirt 49 having cross-sectional dimensions slightly greater than that of the upstanding peripheral side wall 23 for slidable extension downwardly thereover. A plurality of raised deflectable, curved, downwardly projecting hooks (not shown) are formed in spaced apart relation on the inner face of the cover for engagement with respective spaced apart upstanding latches 51 (FIG. 1) formed on the main frame 18 to conveniently and securely yet releasably connect the cover with the main frame.

The main frame 18 is generally rectangular in cross-section and is formed with a planar border defining a platen support tray 40 carried medially from a vertically projecting peripheral rim 42 having slightly smaller dimensions in its bottom extremity than that of the upstanding pan side wall 23 for extension downwardly into the peripheral groove 29 to house the main frame in the pan 14. Such rim 42 is formed in its upper extremity with an inset upstanding peripheral lip 44 projecting upwardly from the platen tray and formed in its opposite sides with a plurality of longitudinally spaced, lateral mounting bores 46 for adjustable engagement with the respective ends of the biasing arms 24 and 26 to adjustably connect the platen and main frames. The top end run of the peripheral wall 42 is likewise formed with a mounting bore 47 (FIG. 3) for adjustable engagement with the biasing arm 22. The platen support tray 40 has formed centrally therein a generally rectangular opening 48 for registration over the light tubes 31 and the lens 45. The opening is formed at one longitudinal end thereof with a generally trapezoidal shaped clearance opening 50 (FIG. 1) terminating in a reduced in dimension rectangular opening 52 for extension therethrough of the gear motor 32 (FIG. 2) as described in greater detail below.

The main frame 18 houses at the bottom end thereof a laterally extending, stationary lower mask holder bar 54 including a U-shaped bracket 58 and a plurality of sharp hooks 56 formed on the upper end thereof and projecting generally downwardly as viewed in FIG. 2 to engage the bores 89 formed along the bottom edge of the mask 83 (FIG. 1). Disposed at the opposite longitudinal end of the main frame is a pivotable laterally extending upper mask holder bar and tensioner 60, likewise including a plurality of sharp hooks 62 formed on the upper end thereof and projecting upwardly as viewed in FIG. 2. The upper mask holder and tensioner is formed at its opposite ends with a rearwardly projecting, fan shaped mounting flanges 64 projecting through respective slots 66 in the platen support tray 40 to mount cylindrical pivot rods (not shown) releasably engaged with respective pairs of opposing, deflectable, downwardly extending mounting tabs (not shown) carried from the underside of the tray 40. Thus the mask holder and tensioner may pivot to a degree dictated by the clearance between the ends of the respective slots and of the opposite edges of respective flanges 64. A plurality of biasing springs 68 (FIG. 2) releasably connect to the mask holder and tensioner 60 to the top run of the upstanding lip 44 and serve to bias such mask holder and tensioner away from the lower holder bar 54 to thereby serve to tightly mount the mask over the main frame. The upper and lower mask holders cooperate to define an anchor assembly for securely mounting the mask immovable to the main frame.

The platen frame 20 is constructed of translucent polycarbonate and is generally box shaped to include a generally peripheral border 71 having an upstanding wall 70 rising upwardly therefrom to form a dome shaped, transparent or translucent platen support window 73 to support thereon the mosaic and allow for the projection therethrough of light from the light tubes 31. Formed at the opposite lateral sides of the platen frame are a pair of eccentric drive mounts, generally designated 75, configured with outwardly opening cut-outs 76 for projection of respective drive pins 78 carried by the pulleys of the respective eccentric drives 28. The eccentric drives mount ball bearing assemblies which may include mounting posts 35 to be themselves received in mounting holes 87 formed in the mosaic 81 or may be formed with eccentrically located, upwardly opening mounting bores 30 formed in the respective inner races for receipt of nylon posts for receipt in such mosaic mounting bores. The top surfaces of the respective ball bearing assemblies may be formed with respective index markers 95 which are located to, for instance, be in a position so when rotated to a location 45 degrees right of respective vertical planes through the axes of such bearing assembles, place the mosaic driven thereby to the upper right quadrant relative to the apertures of the mask 81.

Formed at one longitudinal end of the platen frame is a C-shaped motor mounting bracket, generally designated 80, formed with a generally semi-circular cut-out 82 and including a pair of opposing, inwardly concave gripping straps 84 configured for grasping the opposite sides of the motor body, such arms terminating in respective radially outwardly turned opposing fastener flanges 85 including respective bores for receipt of a screw or other such fastener to securely mount the motor on the platen frame (FIG. 1). Formed in the bottom run of the upstanding wall 70 adjacent the motor mounting bracket are a pair of spaced apart rectangular clearance openings 88 for extension therethrough of respective drive belts 34 (FIG. 2).

The display apparatus as shown in FIGS. 1 and 2 is provided for exemplary purposes to illustrate one display apparatus into which the present invention may be incorporated and is not meant to limit the invention. For example, although a rotary drive assembly is shown and described in which a pair of eccentric drives mount and move a mosaic on a closed loop circular path, it will be appreciated that many other types of drive assemblies could be employed to sequentially register the sets of image pixels with the aperture pattern. A rotary drive assembly could be connected to the mask to move the mask through a circular path in order to achieve the sequential registration of the sets of image pixels with the aperture pattern. A drive assembly could be coupled with either the mosaic or the mask to drive the coupled sheet through a square path to achieve such sequential registration. In addition, a drive assembly may be provided which couples with both the mosaic and mask and which serves to oscillate one of the mask and mosaic in a lateral direction and the other in a longitudinal direction to sequentially display the discrete images. Thus, it is to be appreciated that the present invention is suitable for use with a plurality of display devices incorporating various drive assemblies, and is not to be limited to one particular display device with one type of drive assembly.

Figure 4:
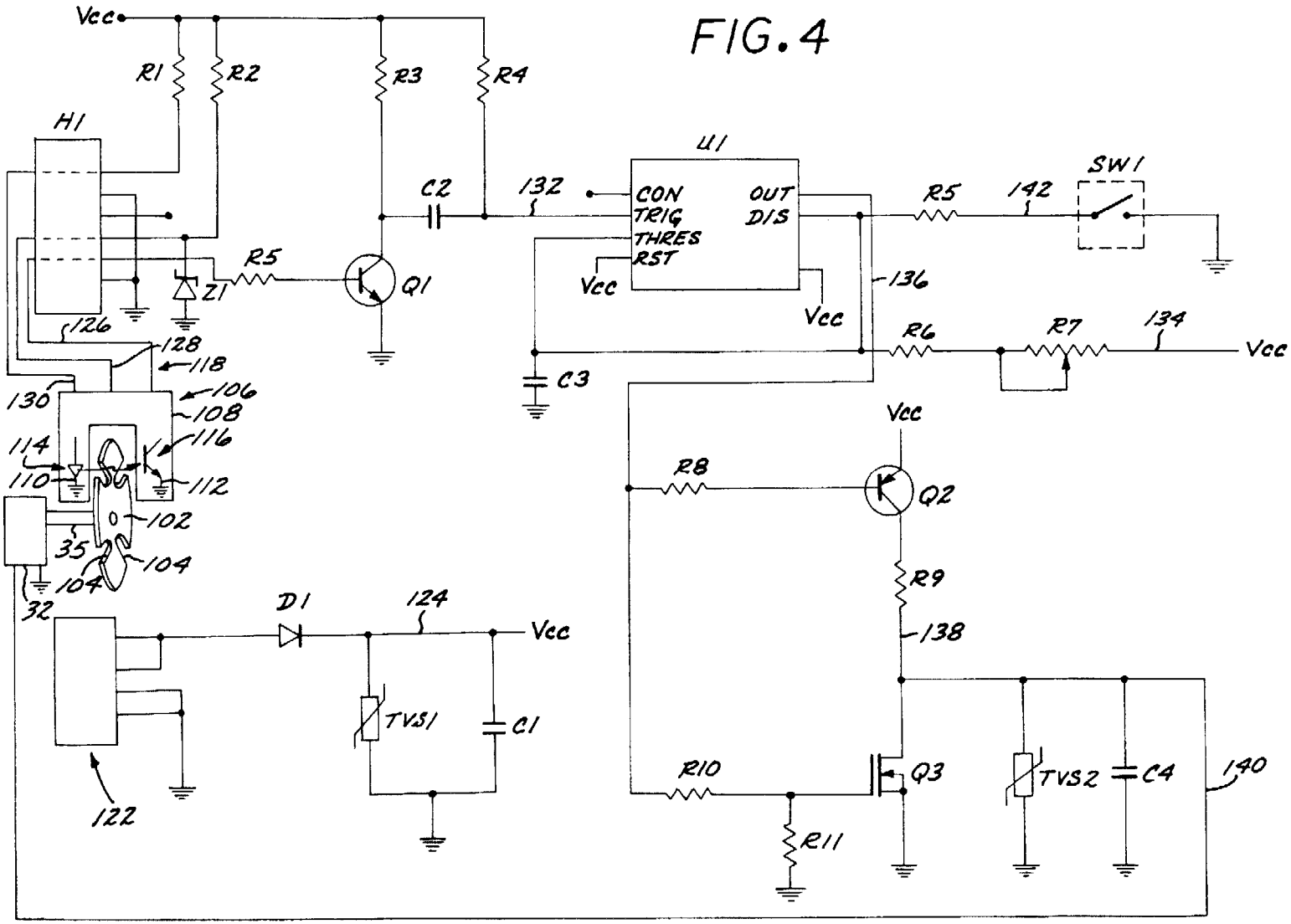
FIG. 4 is a schematic drawing of a timing circuit included in the apparatus shown in FIG. 1.

Referring to FIGS. 1, 3, and 4, there is shown, generally, the control system 100 included in the present invention which is operative to selectively energize and de-energize the DC gear motor assembly 32 to precisely register the discrete images formed on the mosaic 81 with the apertures in the mask 83 and to dwell at those precise positions for predetermined amounts of time before reactuating the gear motor to move the mosaic to the next position. The control system comprises a rotor defined by a location wheel 102 mounted on for rotation with the drive shaft 35 projecting from the gear chain of the gear motor assembly 32 and interposed between the belt pulleys 33 and the motor housing. The wheel is formed with a plurality of radially extending slots 104 spaced a predetermined angular distance apart. In the preferred embodiment, the wheel is formed with four such slots spaced 90 degrees apart on the wheel to correspond with the typical four images interlaced on the mosaic.

The control system 100 further comprises an optical interrupter device, generally designated 106, including a housing 108 comprising a pair of parallel housing segments 110 and 112. Mounted in one of the housing segments is an optical emitter which in the preferred embodiment comprises a photo diode generally designated 114 (FIG. 4). The other of the housing segments houses therein an optical sensor which in the preferred embodiment comprises a photo transistor generally designated 116 (FIG. 4). The housing 108 is connected to electric leads 118 which deliver power to the housing and transmit control signals as described in greater detail below.

The housing 108 and wheel 102 must be configured so as to allow for relative movement therebetween, but also must be disposed in confronting relationship as shown in the figures in order to allow for alignment of the slots 104 with the optical components within the housing. Thus, a suitable bracket or other support means (not shown) may be connected to the housing and to the main frame 18 or other stationary component of the apparatus 10 in order to maintain the housing in its proper position over the slotted wheel.

Referring particularly to FIGS. 2 and 4, there is shown an electronic control circuit, generally designated 120, operative in response to a deactivate control signal transmitted from the optical interrupter device 106 to deactivate the DC gear motor assembly 32 for a predetermined period of time and to reactuate the motor after the predetermined period of time has elapsed. A DC power supply, generally designated 122, provides power to the components included in the circuit across common signal line 124. In the preferred embodiment, an outlet plug (not shown) is provided for connection to a conventional electric outlet to supply power to the apparatus. A diode D1 is connected in series to signal line 124 and acts to provide reverse polarity protection. The diode only conducts current if the power supply polarity is correct. Otherwise, diode D1 does not conduct and thus the circuit cannot be harmed. A transient voltage suppressor TVS1 connects to common signal line 124 and serves to protect the power supply input from power surges. TVS1 comprises a Zener diode and behaves as a forward biased PN junction when polarity is reversed. Thus any surges will be conducted through TVS1 to ground rather than being conducted to the input terminals of the power supply.

A capacitor C1 is also connected to signal line 124 in parallel with transient voltage suppressor TVS1. The voltage build-up across C1 from the power supply 122 defines the Vcc which empowers the remaining components in the circuit.

A header H1 is included in the electronic control unit 120 and serves to electrically connect the optical interrupter device 106 to the circuit. The electric leads 118 connected to the housing 108 comprise an output signal line 126, a power line 128, and an optical signal line 130. The output signal line 126 transmits an output signal generated by the optical interrupter device to the timing circuit. When one of the slots 104 on the wheel 102 aligns with the photo diode 114 and photo transistor 116, the optical signal generated by the photo diode is projected through the slot to the active base region of the photo transistor, thereby turning on the transistor and generating a control signal transmitted on the output signal line 126.

The power line 128 provides a constant voltage to the optical interrupter device to actuate same. In the preferred embodiment, the optical interrupter device employed is Model No. OP13990 from Optek Technology of Carrollton, Tex., which requires a 5 volt power supply voltage. Thus a 5.1 volt Zener diode Z1 and resistor R2 are connected to the power line 128. The Zener diode acts as a voltage regulator and provides constant 5.1 volts to the optical interrupter device, even as the Vcc provided by the power supply 122 varies from 11 to 14 volts.

The optical signal line 130 connects to Vcc through a resistor R1 which serves to limit the current through the optical signal line to approximately 22 mA. This current is continuously supplied to the photo diode 114 and thus during operation of the apparatus the photo diode will be continuously emitting an optical signal.

The output signal line 126 connects to the base of a transistor Q1 through a resistor R5. Thus, when one of the slots 104 on the wheel 102 aligns with the optical interrupter device 106, the output signal goes high on the output signal line. This high output signal saturates transistor Q1 and drives its collector low. A capacitor C2 is located on a signal line 132 connected at one end to the collector region of the transistor Q1 and at the other end to the trigger input of a CMOS timer chip U1. Thus as the output on output signal line 126 goes high, the signal on signal line 132 goes low. Thus transistor Q1 serves as a signal inverter.

The CMOS timer chip U1 is connected through its threshold input to a non-resetable monostable configuration comprising a capacitor C3, resistor R6, and potentiometer R7. The motor stop time is determined by the values of these components. The potentiometer is a 1 mega ohm potentiometer, and thus is adjustable to vary the amount of current flow through signal line 134 generated by Vcc. This in turn affects the rate of voltage build-up across the capacitor C3. Thus the amount of time which passes before the voltage applied to the threshold pin of the timer chip U1 is sufficient to trigger the timer chip is dictated by the potentiometer.

The output pin of the timer chip U1 connects to the base region of a pnp transistor Q2 through a resistor R8 along signal line 136. Because Q2 is a pnp type resistor, when the timer chip output goes low, Q2 is saturated and turns on such that current is conducted through its emitter which turns the gear motor 32 on. Conversely, when the timer chip output goes high, Q2 is turned off which also turns off the motor.

An N-channel metal-oxide-silicon field effect transistor (MOSFET) Q3 has its source region connected to the emitter region of Q2 through resistor R9 along signal line 138, and has its gate region connected to the output pin of the timer chip U1 through resistors R10 and R11. Thus when the timer output goes low, Q3 turns off, and when the timer output goes high, Q3 turns on. In its activated state, Q3 serves to short the current generated by the motor along signal line 140 as the motor coasts to a stop, thereby providing a predictable braking action which will stop the motor very quickly and at a precise position corresponding with the registration of one set of image pixels on the mosaic with the aperture pattern in the mask.

A manually actuated switch SW1 is located on signal line 142, and is operative to short the threshold capacitor C3 to ground through resistor R5. With the switch closed, C3 cannot charge and thus the threshold voltage required to trigger the timer chip U1 cannot be reached. As such, the output pin of the timer chip remains high, thereby keeping the transistor Q2 and thus the motor 32 off. The operator may then perform any maintenance or change-out work on the apparatus. Once such work is completed, the operator may open the switch to allow the capacitor C3 to charge to the threshold level to trigger the timer chip to saturate transistor Q2 to reactuate the motor.

A second transient voltage suppressor TVS2 is connected to signal line 140 and acts to protect the motor terminals from surges. In addition, due to the fact that TVS2 is a very fast Zener diode, it also damps any inductive ringing caused by quickly interrupting motor current.

Thus, the wheel 102 will rotate until one of the slots aligns with the optical transmitter 114 and receiver 116 to generate an output signal on output signal line 126 as the voltage thereon changes from 0 volts to approximately 4 volts. This generates a current through resistor R5 and into the base of transistor Q1, causing Q1 to saturate and driving Q1's collector voltage from Vcc to almost 0 volts. The falling edge of the collector voltage is coupled through capacitor C2 to the trigger input pin of the timer chip U1 thereby triggering the chip. The discharge pin of the timer chip then floats, thus allowing capacitor C3 to charge with a current flowing through resistor R6 and the variable resistor R7. In addition, the output pin of the timer chip goes high, changing from 0 volts to Vcc. This high voltage output turns Q2 off and thus deactivates the motor 32, and also turns Q3 on to act as a short circuit to bring the motor to a quick stop. Although Q2 is off, the inertia of the motor shaft and gear train cause the motor to coast to a stop rather than abruptly stop. Thus Q3 acts to short circuit any current generated by the motor to quickly stop the rotation of the motor.

When capacitor C3 reaches a voltage of ⅔ Vcc or approximately 8 volts, the discharge pin of the timer chip discharges C3 to 0 volts and the timer chip is reset so that its output goes low, turning Q2 and thus the motor 32 on. The wheel 102 will then rotate until the next slot 104 on the wheel aligns with the optical interrupter device to repeat the above-described process.

The resistors and capacitors have the following values:

| | |
|---|---|
| Resistors: | |
| R1 = | 470 ohms |
| R2 = | 330 ohms |
| R3 = | 100K ohms |
| R4, R5, R8 = | 1K ohms |
| R6 = | 130K ohms |
| R7 = | 1M ohm potentiometer |
| R10, R11 = | 10K ohms |
| R9 = | 27 ohms |
| Capacitors: | |
| C1, C2, C4 = | 0.1 micro farads |
| C3 = | 22 micro farads |

The other components have the following values, model numbers and sources:

| Designation | Model Number and Designation | Possible Source |
|---|---|---|
| UP | TLC555CP<br>CMOS timer | Newark |
| Q1 | 2N3904<br>NPN Transistor | Newark |
| Q2 | 2N3906<br>PNP Transistor | Newark |
| Q3 | ZVN4306A<br>MOSFET<br>or<br>ZVN4310A | Digikey |
| Z1 | 1N5321<br>5.1 V Zener Diode | Newark |
| D1 | 1N4004 Diode | Newark |
| TVS1, TVS2 | P6KE24AGICT<br>Transient Voltage Suppressor | Digikey |
| SW1 | Switch<br>PC Mount, SPDT<br>E-Switch #EG1218 | Digikey |

In operation, a user can remove the cover 16 from the pan 14 to expose the main frame 18 and platen frame 20. The user can then select a mosaic 81 (FIG. 5) formed with the images the user wishes to display and mount the mosaic on the platen window 73 and engage the drive bores thereof with the respective eccentrically located projections (posts or roller bearing assemblies) of respective eccentric drives 28. The mask 83 formed with a uniform aperture pattern is mounted on the mask holders 54 and 60 outwardly of the mosaic. The cover is then replaced and the device connected to the power supply 122 and actuated. The gear motor assembly 32 will then operate to drive the eccentric drives which in turn move the mosaic through the predetermined circular path. The location wheel 102 mounted on the drive shaft 35 will then rotate until the optical interrupter device 106 aligns with one of the slots 104 formed in the wheel which triggers the timer chip U1 to turn off transistor Q2 and thus stop the motor abruptly. The timer capacitor C3, resistor R6 and variable resistor R7 serve to, after a predetermined amount of time has elapsed, generate a sufficiently high voltage across capacitor C3 to trigger the timer chip so that its voltage goes negative, thereby saturating transistor Q2 and reactuating the motor to move the mosaic to register the next set of image pixels with the aperture pattern and repeat the process. This procedure is then repeated for the four distinct position as dictated by the location wheel 102.

From the foregoing, it will be appreciated that the display apparatus with a DC gear motor assembly and drive control of the present invention incorporates relatively inexpensive components and is relatively inexpensive to manufacture. In addition, the device incorporates a relatively simple, precise drive assembly controlled by an economical control assembly for interrupting the operation of the drive assembly at various precise dwell points and for reactuating the drive assembly after a predetermined amount of time has elapsed.

While a particular form of the present invention has been illustrated and described, it will also be apparent that various modifications can be made without departing from the spirit and scope of the invention. Accordingly, it is not intended that the invention be limited, except as by the appended claims.

What is claimed is:

1. Display apparatus for displaying for a predetermined amount of time sets of image pixels corresponding with discrete images interlaced on a transparent mosaic sheet through an aperture pattern corresponding with the location of apertures formed in a substantially opaque mask sheet wherein one of said sheets comprises a moveable sheet to be moved through a predetermined path relative to the other of said sheets to sequentially register said apertures with said pixels of said sets, said apparatus being powered by a predetermined power supply, said apparatus comprising:

a housing, including an anchor assembly for fixedly mounting the other of said sheets on said housing;

a platen for mounting said moveable sheet;

an eccentric drive assembly mounted on said housing, engageable with said moveable sheet, and operative to move said moveable platen through said predetermined path to sequentially register said apertures with said pixels of said sets;

a motor device mounted in said housing and electrically connected to said predetermined power supply;

a coupling device coupling said motor device with said drive assembly;

a rotor coupled with said motor device and including a position element rotatable with operation of said motor device;

a sensor for sensing said position element and responsive thereto to generate a stop signal;

a control circuit connected with said sensor and motor device and responsive to said stop signal to stop said motor, said control circuit including a reactivator circuit, said reactivator circuit comprising a capacitor and a potentiometer connected in parallel to a timer chip and to said power supply and operative to trigger said timer chip to reactuate said motor after said predetermined amount of time has elapsed; and a manually actuated control switch electrically connected to said control circuit to deactivate said motor.

2. A display apparatus as set forth in claim 1 wherein:

said rotor includes a disk formed with location openings spaced at selected angular locations; and said sensor is responsive to alignment with said location openings to generate said stop signal.

3. The display apparatus of claim 2 wherein:

said sensor includes an optical transmitter aligned with said openings; and said optical receiver comprises a photo transistor.

4. The display apparatus of claim 2 further including:

a Zener diode electrically connected to said optical receiver and said power supply for supplying a regulated voltage to said optical receiver.

5. The display apparatus of claim 1 wherein:

said timer chip comprises a CMOS timer chip.

6. The display apparatus of claim 2 wherein:

said rotor is circular and includes a periphery; and said plurality of openings comprise four openings spaced ninety degrees apart and extending radially to the periphery of said rotor.

7. The display apparatus of claim 1 wherein:

said control circuit includes a transistor electrically connected to said motor and to said timer chip and operative to short circuit said motor to stop said motor at a precise predetermined angular position.

8. The display apparatus of claim 1 wherein:

said motor device includes a gear chain.

9. The display apparatus of claim 1 wherein:

said motor device is in the form of a DC motor.

10. Display apparatus for sequentially displaying for a predetermined amount of time sets of image pixels corresponding with discrete images interlaced on a transparent mosaic sheet through an aperture pattern corresponding with the location of apertures formed in a substantially opaque mask sheet, said apparatus being powered by a predetermined power supply, said apparatus comprising:

a housing including a mounting assembly for mounting said sheets on said housing;

a drive assembly mounted on said housing, engageable with at least one of said sheets and operative to move said at least one sheet through a predetermined path to sequentially register said apertures with said pixels of said sets;

a motor mounted in said housing and electrically connected to said predetermined power supply and including a rotatable drive shaft;

a coupling device coupling said drive shaft with said drive assembly to translate rotation of said drive shaft into rotation of said drive assembly;

a rotor mounted on said drive shaft for rotation therewith and including a plurality of openings formed a predetermined radial distance from said drive shaft and spaced a predetermined angular distance apart;

an optical system comprising an optical transmitter securely placed on one side of said rotor and disposed said predetermined radial distance from said drive shaft and a predetermined distance from said rotor and aligned with said transmitter, said system being operative to, when transmitter and receiver are aligned with one of said openings, generate a deactivate control signal.

a control circuit, comprising a timer chip, electrically connected to said motor, power supply, and optical system for transmitting power from said power supply to said motor and being responsive to said deactivate control signal to interrupt the delivery of power from said power supply to said motor, said control circuitry further comprising reactuating circuitry responsive to said control signal to reactuate said motor after said predetermined amount of time has elapsed; and a manually actuated control switch electrically connected to said capacitor and to said timer chip and operative to discharge said capacitor to deactivate said motor.

11. The display apparatus of claim 10 wherein:

said reactuating circuitry comprises a capacitor and a potentiometer connected in parallel to said timer chip and to said power supply and operative to trigger said timer chip to reactuate said motor after said predetermined amount of time has elapsed.

12. The display apparatus of claim 10 wherein:

said optical transmitter comprises a photo diode; and said optical receiver comprises a photo transistor.

13. The display apparatus of claim 10 further including:

a Zener diode electrically connected to said optical system and to said power supply for supplying a regulated voltage to said optical system.

14. The display apparatus of claim 10 wherein:

said timer chip comprises a CMOS timer chip.

15. The display apparatus of claim 10 wherein:

said rotor is circular and includes a periphery; and said plurality of openings comprise four openings spaced ninety degrees apart and extending radially to the periphery of said rotor.

16. The display apparatus of claim 10 wherein:

said control circuit includes a transistor electrically connected to said motor and to said timer chip and operative to short circuit said motor to stop said motor at a precise predetermined angular position.

17. Display apparatus for sequentially displaying for a predetermined amount of time sets of image pixels corresponding with discrete images interlaced on a transparent mosaic sheet through an aperture pattern corresponding with the location of apertures formed in a substantially opaque mask sheet, said apparatus being powered by a predetermined power supply, said apparatus comprising:

a housing including mounting assembly for mounting said sheets on said housing;

a drive assembly mounted on said housing, engageable with at least one of said sheets and operative to move said at least one sheet through a predetermined path to sequentially register said apertures with said pixels of said sets;

a motor mounted in said housing and electrically connected to said predetermined power supply and including a rotatable drive shaft;

a coupling device coupling said drive shaft with said drive assembly to translate rotation of said drive shaft into rotation of said drive assembly;

an optical system comprising an optical transmitter for transmitting an optical signal along an optical path and an optical receiver disposed in said optical path for receiving said optical signal and responsive to said optical signal to generate a deactivate control signal;

a rotor coupled with said drive shaft for rotation therewith in said optical path said rotor including a plurality of blocking elements spaced angularly apart and having radial lateral edges defining a plurality of elongated radial transmission slots located between said blocking elements, said blocking elements normally operative to prevent transmission of said optical signal along said optical path and said transmission slots operative to accommodate transmission of said optical signal along said optical path; and a control circuit electrically connected to said motor, power supply and optical system for transmitting power from said power supply to said motor and being responsive to said deactivate control signal to interrupt the delivery of power from said power supply to said motor, said control circuitry further comprising reactuating circuitry responsive to said control signal to reactuate said motor after said predetermined amount of time has elapsed.

18. The display apparatus of claim 17 wherein:

said control circuit comprises a timer chip.

19. The display apparatus of claim 18 wherein:

said reactuating circuitry comprises a capacitor and a potentiometer connected in parallel to said timer chip and to said power supply and operative to trigger said timer chip to reactuate said motor after said predetermined amount of time has passed.

20. The display apparatus of claim 18 that includes:

a manually actuated control switch electrically connected to said control circuit and operative to deactivate said motor.

21. The display apparatus of claim 20 further comprising:

said manually actuated control switch electrically connected to said capacitor and to said timer chip and operative to discharge said capacitor to deactivate said motor.

22. The display apparatus of claim 17 wherein:

said optical transmitter comprises a photo diode; and said optical receiver comprises a photo transistor.

23. The display apparatus of claim 17 further including:

a Zener diode electrically connected to said optical system and to said power supply for supplying a regulated voltage to said optical system.

24. The display apparatus of claim 18 wherein:

said timer chip comprises a CMOS timer chip.

25. The display apparatus of claim 17 wherein:

said rotor is circular and includes a periphery; and said plurality of openings comprise four openings spaced ninety degrees apart and extending radially to the periphery of said rotor.

26. The display apparatus of claim 17 wherein:

said control circuit includes a transistor electrically connected to said motor and to said timer chip and operative to short circuit said motor to stop said motor at a precise predetermined angular position.

* * * * *